US011448018B2

(12) United States Patent
Weddle et al.

(10) Patent No.: US 11,448,018 B2
(45) Date of Patent: Sep. 20, 2022

(54) POWER TONG FRAME STIFFNER

(71) Applicant: Eckel Manufacturing Co. Inc., Odessa, TX (US)

(72) Inventors: Dwayne Austin Weddle, Odessa, TX (US); Randolph L. Stuart, Odessa, TX (US)

(73) Assignee: ECKEL MANUFACTURING CO., INC., Odessa, TX (US)

( * ) Notice: Subject to any disclaimer, the term of this patent is extended or adjusted under 35 U.S.C. 154(b) by 465 days.

(21) Appl. No.: 16/148,350

(22) Filed: Oct. 1, 2018

(65) Prior Publication Data

US 2019/0136649 A1 May 9, 2019

Related U.S. Application Data

(60) Provisional application No. 62/568,150, filed on Oct. 4, 2017.

(51) Int. Cl.
*E21B 19/16* (2006.01)
*B25B 13/50* (2006.01)

(52) U.S. Cl.
CPC ..... *E21B 19/164* (2013.01); *B25B 13/5066* (2013.01); *B25B 13/5075* (2013.01); *E21B 19/168* (2013.01)

(58) Field of Classification Search
CPC ..... E21B 19/164; E21B 19/168
See application file for complete search history.

(56) References Cited

U.S. PATENT DOCUMENTS 1,767,434 A * 6/1930 Childs ..... B25B 17/00 81/57.29
4,221,269 A * 9/1980 Hudson ..... E21B 19/168 173/222
4,346,629 A * 8/1982 Kinzbach ..... E21B 19/164 81/57.15
5,172,613 A * 12/1992 Wesch, Jr. ..... B25B 13/5075 81/57.11
6,058,811 A 5/2000 Stuart
2003/0177870 A1 9/2003 Neves

FOREIGN PATENT DOCUMENTS

GB 2344781 A 6/2000

OTHER PUBLICATIONS

International Search Report and the Written Opinion of the International Searching Authority; (ISA) International Searching Authority; dated Jan. 28, 2019.

* cited by examiner

*Primary Examiner* — Hadi Shakeri
(74) *Attorney, Agent, or Firm* — Patrick K. Steele

(57) ABSTRACT

A frame stiffener for a power tong frame comprises a body having a top surface securable to a top plate of the frame, a bottom surface securable to the bottom plate of the frame, an outer side and an interior side having a plurality of recesses, each recess formed to conform to an angular portion of an adjacent dumbbell roller secured within the frame along with a plurality of other dumbbell rollers to rollably surround, engage and stabilize a ring gear rotatably disposed within the frame.

10 Claims, 4 Drawing Sheets

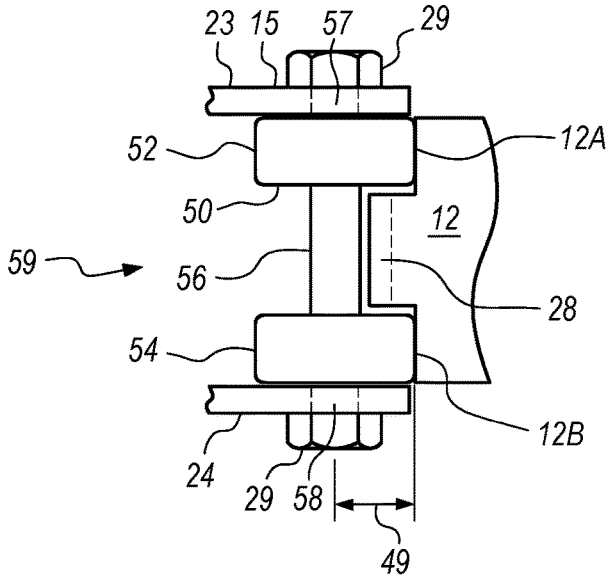
FIG. 2A (PRIOR ART)
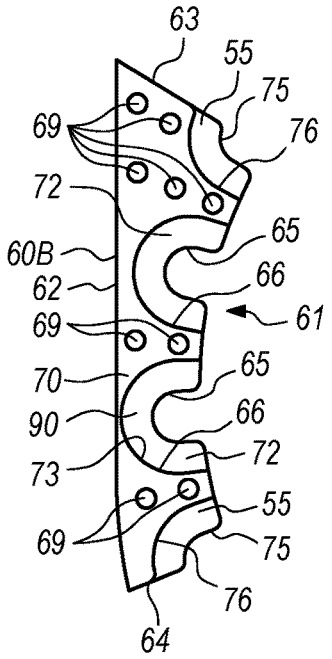
FIG. 3
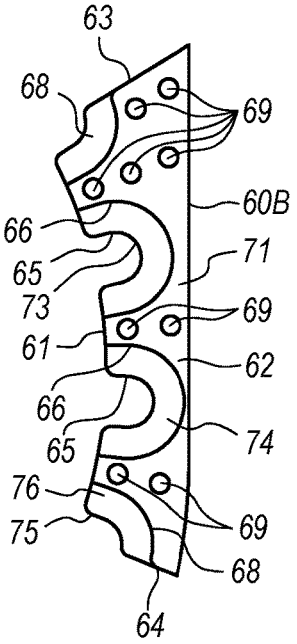
FIG. 4
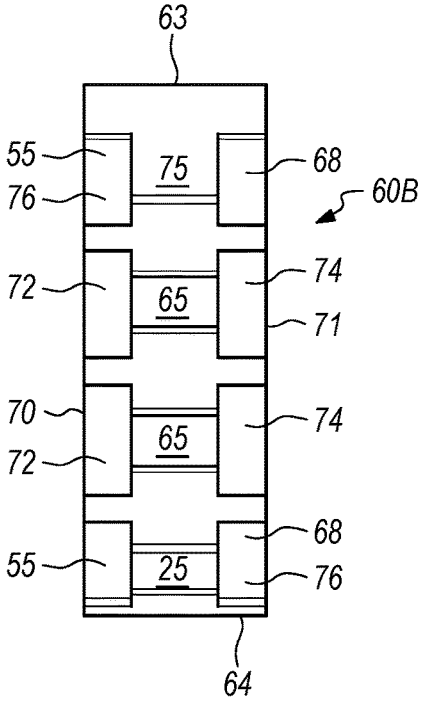
FIG. 5
FIG. 6
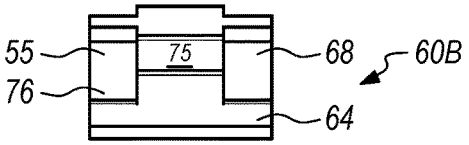

POWER TONG FRAME STIFFNER

STATEMENT OF RELATED APPLICATIONS

This application depends from and claims priority to U.S. Provisional Patent Application Ser. No. 62/568,150 filed on Oct. 4, 2017.

BACKGROUND

Field of the Invention

The present invention relates to power tongs used for gripping and rotating tubular members having threaded connections. More specifically, the present invention relates to stiffeners for power tong frames to prevent unwanted warping and deformation of the frame resulting from the application of large amounts of torque.

Background of the Related Art

Power tongs are machines used for gripping and rotating tubular joints as they are being threadedly joined to an adjacent threaded tubular joint to form a tubular string. One type of power tong includes an open throat through which a tubular joint is laterally introduced into the machine to be gripped and rotated. Another type of power tong does not have an open throat, and tubular joints must be introduced by inserting an end of the tubular joint into the machine. A power tong typically includes a ring gear rotatably disposed within a power tong frame, the ring gear having a plurality of teeth about its periphery and a pair of opposed camming surfaces disposed within an interior bay. The camming surfaces surround and engage a pair of deployable gripping jaws that, as the ring gear rotates about them, adduct one towards the other to approach, engage and grip a tubular joint introduced therebetween. Continued rotation of the ring gear within the power tong frame rotates the gripped tubular joint about its axis to make up a threaded connection between a threaded end of the tubular joint and an aligned and threaded end of an adjacent tubular joint. As additional tubular joints are added, the tubular string is extended.

The ring gear is rotated within the frame by a motor and connected gears that engage the peripheral teeth of the ring gear. The type of power tong having an open throat requires that two drive gears, one spaced from the other, engage the peripheral teeth of the ring gear so that a gap that coincides with the open throat of the frame can rotate past one drive gear while the other drive gear remains engaged with the peripheral teeth of the ring gear.

The ring gear may be rotatably secured within the frame by a plurality of dumbbell rollers. Each dumbbell roller is connected intermediate a top plate and a bottom plate of the power tong frame, and each dumbbell roller includes a circular top portion connected to a circular bottom portion by a vertical axle. The circular top portion of each dumbbell roller engages the ring gear above the peripheral teeth, and the circular bottom portion engage the ring gear below the peripheral teeth. A recess intermediate the circular top portion and the circular bottom portion, and adjacent the axle, accommodates the peripheral teeth of the ring gear as the ring gear rotates within the frame. The plurality of dumbbell rollers together surround and engage the rotating ring gear to stabilize the ring gear against unwanted spreading as large forces are applied to the gripping jaws.

BRIEF SUMMARY

One embodiment of the present invention provides a power tong for gripping and rotating a tubular joint, the power tong comprising a frame having a top plate, a bottom plate parallel to the top plate, a first side wall extending from a first side edge of the top plate to a first side edge of the bottom plate, and a second side wall extending from a second side edge of the top plate to a second side edge of the bottom plate, the first side wall being opposite to and spaced apart from the second side wall of the frame, a ring gear rotatably received within the frame, the ring gear having an interior bay for receiving the tubular joint, a pair of interior opposed camming surfaces straddling the interior bay and a radially outwardly extending row of gear teeth about a periphery of the ring gear, a pair of opposed gripping jaws movably captured within the interior bay of the ring gear proximal to the opposed camming surfaces, the gripping jaws deployable, by rotation of the ring gear and the camming surfaces thereof within the frame, from a retracted position, within a pair of opposed recesses formed in the interior bay of the ring gear, to a deployed position radially inwardly towards a center axis of the interior bay of the ring gear to engage and grip the tubular joint, a motor, a drive gear coupled to be driven to rotate by operation of the motor, at least one driven gear coupled to be driven to rotate by the drive gear to transfer torque from the motor, through the drive gear and the at least one driven gear to the ring gear by engagement of peripheral teeth on the at least one driven gear with the teeth on the periphery of the ring gear, a first plurality of dumbbell rollers secured within the frame in a first bend along a first side periphery of the ring gear on a first side of the frame, intermediate the periphery of the ring gear and the first side wall, each dumbbell roller of the first plurality of dumbbell rollers rotatably secured intermediate the top plate and the bottom plate, each dumbbell roller of the first plurality of dumbbell rollers having a top rolling member having a first radius positioned to rollably engage the periphery of the ring gear above the row of gear teeth, a bottom rolling member having a second radius positioned to rollably engage the periphery of the ring gear below the row of gear teeth, and a circumferential groove intermediate the top rolling member and the bottom rolling member, a second plurality of dumbbell rollers secured within the frame in a second bend along a second side periphery of the ring gear and on a second side of the frame, intermediate the ring gear and the second side wall, each dumbbell roller of the second plurality of dumbbell rollers rotatably secured intermediate the top plate and the bottom plate, each of the dumbbell rollers of the second plurality of dumbbell rollers having a top rolling member having the first radius positioned to rollably engage the periphery of the ring gear above the row of gear teeth, a bottom rolling member having the second radius positioned to rollably engage the periphery of the ring gear below the row of gear teeth, and a circumferential groove intermediate the top rolling member and the bottom rolling member, a first side frame stiffener disposed intermediate the first side wall of the frame and the first plurality of dumbbell rollers and intermediate the top plate and the bottom plate of the frame, the first side frame stiffener having a top surface secured to the top plate of the frame, a bottom surface secured to the bottom plate of the frame, a proximal end proximal a rear of the frame, a distal end opposite the proximal end and proximal a front of the frame, an outer side disposed proximal to the first side wall and an interior side having a plurality of recesses, each of the plurality of recesses including a top portion with a mouth proximal to the interior bay, a bottom portion with a mouth proximal to the interior bay, and a protruding stiffening rib disposed intermediate the top portion and the bottom portion of each recess, the protruding stiffening rib received within the circumferential groove of an adjacent dumbbell roller of the first plurality of dumbbell rollers, and a second side frame stiffener disposed intermediate the second side wall of the frame and the second plurality of dumbbell rollers and intermediate the top plate and the bottom plate of the frame, the second side frame stiffener having a top surface secured to the top plate, a bottom surface secured to the bottom plate, a proximal end proximal the rear of the frame, a distal end opposite the proximal end and proximal the front of the frame, an outer side disposed proximal to the second side wall and an interior side having a plurality of recesses, each of the plurality of recesses including a top portion with a mouth proximal to the interior bay, a bottom portion with a mouth proximal to the interior bay, and a protruding stiffening rib disposed intermediate the top portion and the bottom portion of each recess, the protruding stiffening rib received within the circumferential groove of an adjacent dumbbell roller of the second plurality of dumbbell rollers, wherein, during operation of the power tong, torque produced by the motor is transferred through the drive gear and the at least one driven gears to the ring gear to rotate the ring gear to engage the straddling pair of camming surfaces with the opposed gripping jaws and to deploy the gripping jaws to adduct each towards the other to engage and grip the tubular joint therebetween, wherein as the ring gear continues to rotate after the gripping jaws engage and grip the tubular joint, the tubular joint rotates with the ring gear and the pair of engaged gripping jaws, and wherein the first side frame stiffener and the second side frame stiffener resist deformation of the frame.

The first side frame stiffener and/or the second side frame stiffener of the power tong frame may further include a truncated recess at a proximal end of the first side frame stiffener and/or the second side frame stiffener, the truncated recess including a top portion having a radius exceeding the first radius, a bottom portion having a radius exceeding the second radius, and a protruding stiffening rib disposed intermediate the top portion and the bottom portion of the truncated recess, the protruding stiffening rib received within the circumferential groove of an adjacent dumbbell roller of the first plurality of dumbbell rollers.

The first side frame stiffener and/or the second side frame stiffener of the power tong frame may further include a truncated recess at a second end of the first side frame stiffener, the truncated recess including a top portion having a radius exceeding half of the first radius, a bottom portion having a radius exceeding half of the second radius, and a protruding stiffening rib received in the circumferential groove of an adjacent dumbbell roller of the first plurality of dumbbell rollers. The first side frame stiffener and/or the second side frame stiffener of the power tong frame may further include at least one inwardly extending divider intermediate a first recess and a second recess, the inwardly extending divider extending inwardly towards the interior bay and inwardly from the arc portions of two of the plurality of recesses between which the inwardly extending divider extends, wherein the at least one inwardly extending divider positions the mouth of each of the two of the plurality of recesses proximal to the interior bay.

In one embodiment of the power tong frame stiffener of the present invention, each of the plurality of recesses of the interior side of the first side frame stiffener and/or the second side frame stiffener may further include an arc portion, wherein each of the plurality of recesses of the interior side of the first side frame stiffener outwardly terminates at an arc portion forming an arc of 180 degrees. Alternately, each of the plurality of recesses of the interior side of the first side frame stiffener and/or the second side frame stiffener may terminate at a non-arced portion such as, but not limited to, a half-polygonal structure such as a half-hexagonal (three-sided), a half-octogonal (four-sided), or some other shape opening towards the mouth of the recess.

The first side frame stiffener and/or the second side frame stiffener may be secured within a power tong frame using fasteners and or welding. For example, but not by way of limitation, the first side frame stiffener and/or the second side frame stiffener may include a plurality of threaded holes in the top surface and a plurality of threaded holes in the bottom surface, wherein the first side frame stiffener and/or the second side frame stiffener is/are secured intermediate the top plate and the bottom plate of the frame by a plurality of threaded fasteners, each of which penetrate one of an aperture in the top plate of the frame and an aperture of the bottom plate of the frame, and each of which are threadedly received into one of the plurality of threaded holes in one of the top surface and the bottom surface of the first side frame stiffener and/or the second side frame stiffener.

The first side frame stiffener and/or the second side frame stiffener may be machined from a high-strength material such as, for example, steel, for resistance to deformation of the frame of the power tong during operation.

The plurality of recesses are formed into the interior side of the first side frame stiffener and/or the second side frame stiffener to dispose the top portion of each of the plurality of recesses proximal to the top rolling member of the adjacent dumbbell roller and to dispose the bottom portion of each of the plurality of recesses proximal to a bottom rolling member of the adjacent dumbbell roller. For example, but not by way of limitation, the first side frame stiffener may include a plurality of recesses, each having a top portion and a bottom portion separated by a protruding rib formed into the interior side and the first side frame stiffener, and the first side frame stiffener can be secured within the frame of the power tong to dispose an arced portion of the plurality of top portions proximal to the top rolling members of the first plurality of dumbbell rollers and to dispose an arced portion of the plurality of bottom portions of each of the plurality of recesses proximal to the bottom rolling members of the first plurality of dumbbell rollers. The arced portions may be of a radius that is slightly larger than the radius of the respective top rolling members and bottom rolling members, respectively, of the first plurality of dumbbell rollers, to provide clearance for rotation of the plurality of dumbbell rollers, and to dispose the central protruding rib of each of the plurality of recesses within the groove formed intermediate the top rolling member and the bottom rolling member of the adjacent dumbbell roller of the first plurality of dumbbell rollers. This arrangement provides optimal reinforcement to the power tong frame without hindering the rotation of the plurality of dumbbell rollers disposed proximal to the plurality of recesses of the first side frame stiffener. It will be understood that the second side frame stiffener may be disposed in a similar arrangement with the second plurality of dumbbell rollers.

It will be understood by those familiar with power tongs that there may be one or two or more driven gears coupled to be driven by operation of the motor, and that in power tongs having an open throat for lateral introduction of tubular joints into the power tong interior bay, two driven gears are provided in a spaced-apart arrangement so that the ring gear of the power tong and continue to rotate as driven by one of the two driven gears when the open throat of the ring gear is aligned with the other of the two driven gears. Alternately, in power tongs into which tubular joints are introduced axially, a single driven gear can be used to rotate the ring gear which has no open throat and which has a continuous circumference with teeth for engage the driven gear.

Another embodiment of the present invention comprises a frame stiffener for a power tong used to grip and rotate a tubular joint to make up a threaded connection between the tubular joint and a tubular string, the frame stiffener comprising an interior side, an outer side opposite the interior side, a top surface intermediate the interior side and the outer side, a bottom surface opposite the top surface and intermediate the interior side and the outer side, and a plurality of recesses along the interior side, each recess having a top portion separated from a bottom portion by a protruding stiffening rib, the top portion of each of the plurality of recesses being proximal to the top surface and shaped to conform to a top rolling member of a dumbbell roller used in a power tong to engage and stabilize a ring gear during rotation, the bottom portion of each of the plurality of recesses being proximal to the bottom surface and shaped to conform to a bottom rolling member of the dumbbell roller, and the protruding rib intermediate the top portion and the bottom portion conforming to the shape of a groove of the dumbbell roller that is intermediate the top rolling member and the bottom rolling member, wherein the top surface of the frame stiffener is securable to a top plate of a power tong frame, wherein the bottom surface of the frame stiffener is securable to a bottom plate of a power tong frame and wherein the frame stiffener provides resistance to deformation of the power tong frame during operation. It will be understood that each of the top portion and/or the bottom portion of each of the plurality recesses conforms to the top rolling member and/or bottom rolling member, respectively, of the adjacent dumbbell roller in a manner that provides clearance for unimpaired rotation of the dumbbell roller but that surrounds at least an angular portion of the top portion and/or bottom portion of the dumbbell roller. This arrangement provides for increased span and areal extent of the stiffener within the power tong frame and, when secured to the top plate and the bottom plate of the power tong frame, provides for resistance to deformation of the power tong frame during operation of the power tong.

A preferred embodiment of the frame stiffener includes a plurality of threaded holes in the top surface of the frame stiffener, each for threadedly receiving a threaded fastener inserted through one of a plurality of holes in a top plate of a power tong frame, and a plurality of threaded holes in the bottom surface, each for threadedly receiving a threaded fastener inserted through one of a plurality of holes in the bottom plate of a power tong frame. One embodiment of the frame stiffener further includes a plurality of threaded holes in the outer side of the frame stiffener, each for receiving a threaded fastener inserted through one of a plurality of holes in a side wall of a power tong frame, the side wall extending from a first side edge of the top plate to a first side edge of the bottom plate.

Another embodiment of a frame stiffener for providing resistance to deformation of a frame of a power tong comprises a body having a top surface securable to the top plate of the power tong frame, a bottom surface securable to a bottom plate of the frame, a proximal end, a distal end opposite the proximal end, an outer side and an interior side having a plurality of recesses, each of the plurality of recesses including a top portion with a mouth and an arced portion having a first radius, a bottom portion with a mouth an arced portion having a second radius, and a protruding stiffening rib disposed intermediate the top portion and the bottom portion of each recess wherein the frame stiffener is adapted for being secured within a power tong frame intermediate a rotating assembly and a side wall of the power tong frame and wherein the frame stiffener resists deformation of the frame during operation of the power tong. Alternately, each of the plurality of recesses may terminate in a non-arced portion such as, for example, a half-polygonal shape such as a half-hexagonal or a half-octogonal shape. It will be understood that the recess can surround at least a portion of the adjacent dumbbell roller using a variety of shapes, and that an arced portion of the recess provides for but one shape that conforms to the top rolling member and/or bottom rolling member of the adjacent dumbbell roller.

The appended drawings illustrate an embodiment of the frame stiffener and/or the power tong of the present invention, and should not be construed as limiting of the present invention, which is limited only by the claims appended hereto.

BRIEF DESCRIPTION OF THE SEVERAL VIEWS OF THE DRAWINGS

FIG. 2A is a sectional view of a dumbbell roller disposed intermediate the top plate and the bottom plate of the power tong frame to engage and stabilize the ring gear.

FIG. 3 is a top plan view of an embodiment of a second side stiffener for a first side of a power tong frame.

FIG. 4 is a bottom plan view of an embodiment of a second side frame stiffener for a second side of a power tong frame.

FIG. 5 is an interior side view of the second side frame stiffener of FIG. 3.

FIG. 6 is a distal end view of the second side frame stiffener of FIGS. 3 and 5.

DETAILED DESCRIPTION

Figure 1:
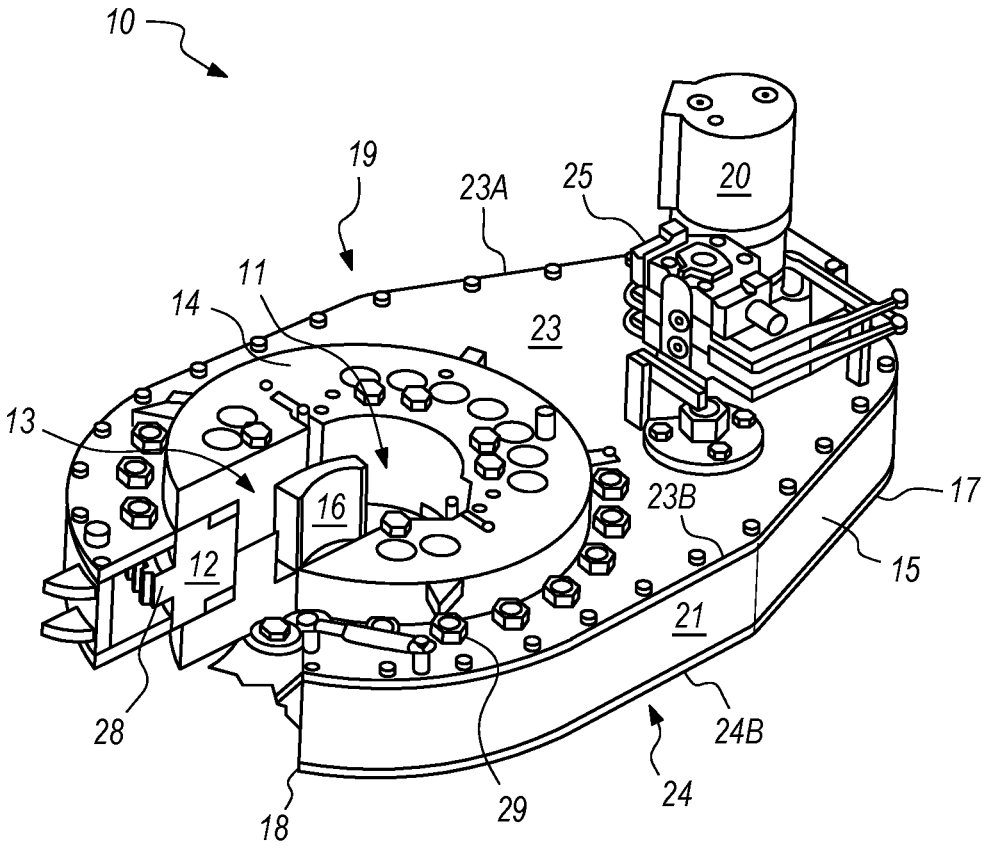
FIG. 1 is a perspective view of a power tong for gripping and rotating tubular joints, the power tong having a frame and a rotatable assembly therewithin.

FIG. 1 is a perspective view of an embodiment of a power tong 10 of the present invention for gripping and rotating tubular joints (not shown), the power tong 10 having a frame 15 and a rotatable assembly 14 therewithin, the rotatable assembly 14 including a pair of opposed gripping jaws 16 movably secured within the rotatable assembly 14 and a ring gear 12 having an interior bay 11 and an open throat 13 through which a tubular joint (not shown) can be laterally introduced into the interior bay 11 to be gripped and rotated by the pair of gripping jaws 16.

The frame 15 of the power tong 10 of FIG. 1 includes a rear 17, a front 18, a first side wall 19 (not shown in FIG. 1), a second side wall 21 opposite the first side wall 19, a top plate 23 extending from the first sidewall 19 to the second side wall 21, the top plate 23 having a first side edge 23A and a second side edge 23B, and a bottom plate 24 having a first side edge 24A (not shown in FIG. 1) and a second side edge 24B. The first side wall 19 (not shown in FIG. 1 but indicated by arrow) of the frame 15 of the power tong 10 extends from the first side edge 23A of the top plate 23 to the first side edge 24A (not shown in FIG. 1) of the bottom plate 24. The second side wall 21 of the frame 15 of the power tong 10 extends from the second side edge 23B of the top plate 23 to the second side edge 24B of the bottom plate 24.

The power tong 10 of FIG. 1 further includes a motor 20 and a control unit 25. The control unit 25 is used to engage and disengage the motor 20 from rotating the ring gear 12 of the rotating assembly 14 of the power tong 10 that is used to deploy the gripping jaws 16 to grip, rotate and release a tubular joint (not shown). The door of the power tong 10 that closes the throat 13 is omitted from FIG. 1 to reveal interior features.

Figure 2:
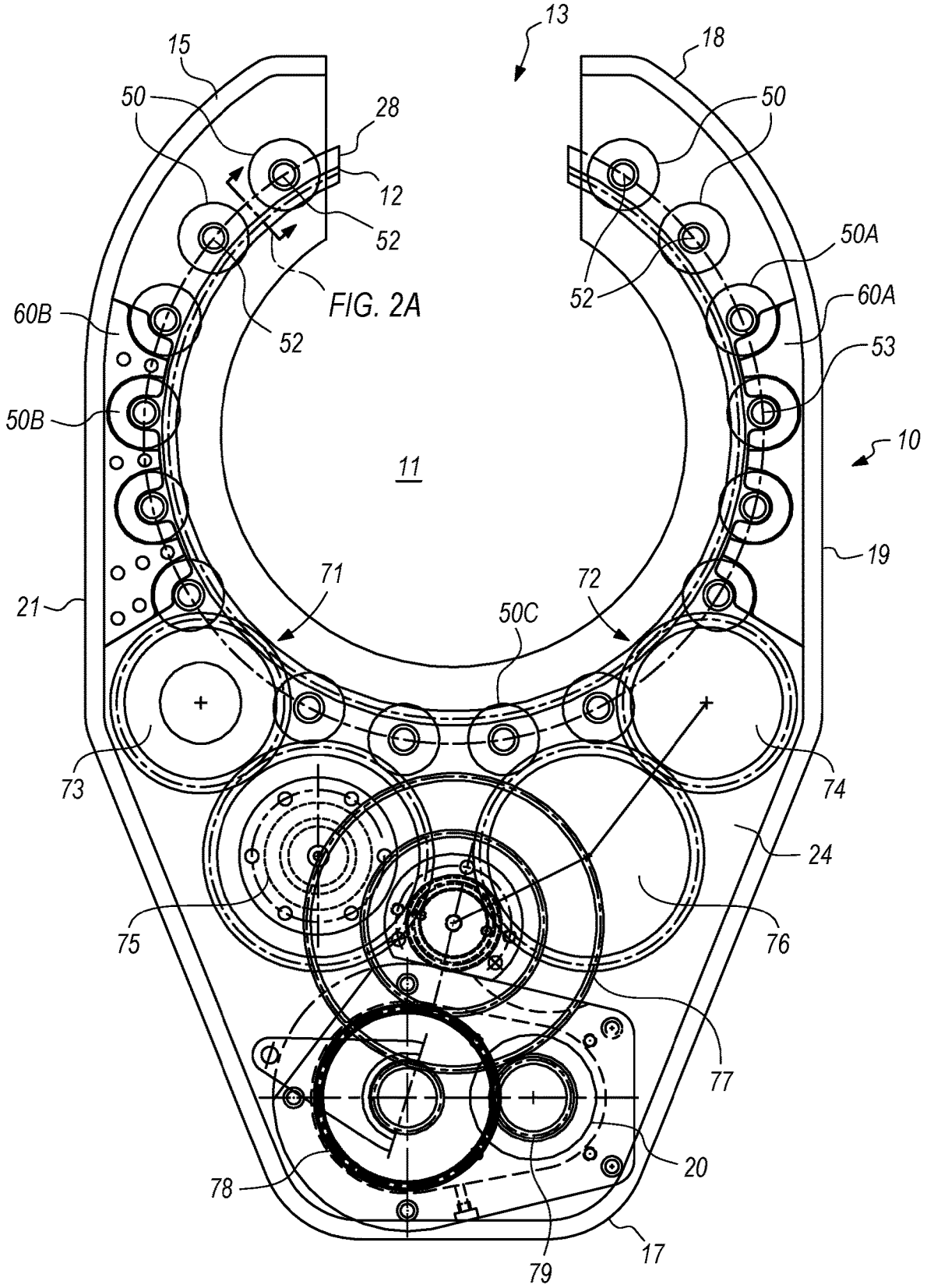
FIG. 2 is a sectional plan view of the power tong of FIG. 1 revealing a plurality of dumbbell rollers to stabilize a ring gear rotatably disposed within the power tong frame, and a first side frame stiffener and a second side frame stiffener disposed on the left and the right side of the rotatable ring gear, respectively.

FIG. 2 is a sectional plan view of the power tong 10 of FIG. 1 with the rear 17 of the frame 15 of the power tong 10 at the bottom of the drawing and the front 18 of the frame 15 of the power tong 10 at the top of the drawing. FIG. 2 reveals a plurality of dumbbell rollers 50 rotatably secured within the frame 15 intermediate the top plate 23 (not shown in FIG. 2—see FIG. 1) and the bottom plate 24 of the power tong frame 15. The dumbbell rollers 50 are secured intermediate the frame 15 and the ring gear 12 to rollably engage and stabilize the ring gear 12 that is rotatably disposed within the frame 15. The power tong 10 of FIG. 2 further includes a first side frame stiffener 60A and a second side frame stiffener 60B disposed within the frame 15 and on each side of the rotatable ring gear 12.

More specifically, the plurality of dumbbell rollers 50 are arranged in the power tong 10 of FIG. 2 in three groups: a first bend 50A of dumbbell rollers 50, a second bend 50B of dumbbell rollers 50 and a third bend 50C of dumbbell rollers 50 (each of the three bends 50A, 50B and 50C of dumbbell rollers 50 on a common dashed centerline and separated one from the others by one or both of the drive gears 83 and 74 that engage and drive the ring gear 12 to rotate within the plurality of dumbbells 50). Two of the bends of dumbbell rollers, the first bend 50A and the second bend 50B, are opposed, meaning that the first bend 50A of dumbbell rollers 50 is disposed on the right side of FIG. 2 intermediate the first side wall 19 and the ring gear 12, and the second bend 50B of dumbbell rollers 50 is disposed on the left side of FIG. 2 intermediate the second side wall 21 and the ring gear 12. The third bend 50C of dumbbell rollers 50 are disposed proximal to the rear 17 of the frame 15 of the power tong 10 and intermediate the first bend 50A and the second bend 50B. The first side frame stiffner 60A is disposed within the frame 15 intermediate the first side wall 19 and the first bend 50A of dumbbell rollers 50 and the second side frame stiffener 60B is disposed within the frame 15 and intermediate the second side wall 21 and the second bend 50B of dumbbell rollers 50.

The power tong 10 of FIG. 2 includes a motor 20 having a drive gear 79 engaging a first intermediate step gear 78. The first intermediate step gear 78 engages a second intermediate step gear 77, and the second intermediate step gear 77 engages a pair of third intermediate gears 85 and 76. The pair of third intermediate gears 85 and 76 engage a pair of driven gears 83 and 74, respectively. The ring gear 12 includes peripheral teeth 28 that are engaged and rotated, upon activation of the motor 20, by corresponding teeth (not shown) on the pair of driven gears 83 and 74. The pair of driven gears 83 and 74 are spaced apart one from the other so that the open throat 13 of the ring gear 12 can be aligned with one or the other of the driven gears 83 and 74 without a loss of positive engagement between the motor 20 and the ring gear 12, as is known in the art for power tongs having an open throat.

The first bend 50A of dumbbell rollers 50, the second bend 50B of dumbbell rollers 50 and the third bend 50C are each disposed in a curved arrangement wherein the collective centers 53 of each dumbbell roller 50 lie on a circle that is concentric with and slightly larger than the ring gear 12. This positioning provides that each dumbbell roller 50 is in a position to engage and rollably stabilize the open-throated ring gear 12 against unwanted deformation as the power tong 10 is operated to apply torque to a tubular member (not shown) introduced into the interior bay 11.

FIG. 2A is a sectional view of a typical dumbbell roller 50 disposed intermediate the top plate 23 and the bottom plate 24 of the frame 15 to engage and stabilize the ring gear 12. The dumbbell roller 50 of FIG. 2A includes a top rolling member 52 and a bottom rolling member 54 spaced apart from the top rolling member 52. The top rolling member 52 and the bottom rolling member 54 are coupled one to the other by an axle 56 extending vertically therebetween. In one embodiment, the axle 56 extends beyond the top rolling member 52 and penetrates an aperture 57 in the top plate 23, and the axle 56 extends beyond the bottom rolling member 54 and penetrates an aperture 58 in the bottom plate 24 of the frame 15 of the power tong 10. In another embodiment, the axle 56 is integrally formed with the top rolling member 52 and the bottom rolling member 54. The axle 56, or portions of the axle 56 extending beyond the top rolling member 52 and the bottom rolling member 54, may be threaded to engage nuts 29 threadedly received thereon to rotatably secure the dumbbell roller 50 in place within the frame 15 of the power tong 10. The top rolling member 52, the bottom rolling member 54 and the portion of the axle 56 therebetween of the dumbbell roller 50 together form a groove 59 to accommodate the peripheral teeth 28 of the ring gear 12. The top rolling member 52 of the dumbbell roller 50 rollably engages a top shoulder 12A of the ring gear 12 and the bottom rolling member 54 of the dumbbell roller 50 rollably engages a bottom shoulder 12B of the ring gear 12 as the ring gear 12 rotates as driven by operation of the motor 20 (not shown in FIG. 2A—see FIG. 2). In this manner, the first bend 50A, the second bend 50B and the third bend 50C of dumbbell rollers 50 together engage and stabilize the ring gear 12 against unwanted deformation as it is driven by the motor 20 to rotate and apply torque to a tubular member.

It will be understood that the substantial forces imparted by the gripping jaws 16 to the ring gear 12, and by the ring gear 12 to the dumbbell rollers 50, are ultimately transferred to and brought to bear on the frame 15 of the power tong 10 (see FIG. 2). As a result, the frame 15 of the power tong 10 may become warped or deformed, and may thereby impair the capacity of the gripping jaws 16 to efficiently and reliably grip and rotate a tubular member (not shown) unless substantial warping or deformation is prevented. Embodiments of the first side frame stiffener 60A and the second side frame stiffener 60B of the present invention provide the needed reinforcement of the frame 15 of the power tong 10 and embodiments of the power tong 10 of the present invention may have reduced weight and improved mobility on a rig floor as a result of the first side frame stiffener 60A and the second side frame stiffener 60B.

FIG. 3 is a top plan view of an embodiment of the second side frame stiffener 60B for being disposed within a frame 15 of a power tong 10 to prevent unwanted warping or deformation of the frame 15. FIG. 3 reveals the second side frame stiffener 60B prior to being installed within the frame 15 for providing resistance to warping and/or deformation of the frame 15. The second side frame stiffener 60B includes an interior side 61, an outer side 62 opposite the interior side 61, a top surface 70 intermediate the interior side 61 and the outer side 62, a bottom surface 71 (not shown in FIG. 3) opposite the top surface 70 and intermediate the interior side 61 and the outer side 62, and a plurality of recesses 66 disposed along the interior side 61 of the second side frame stiffener 60B. Each of the recesses 66 includes a top portion 72 separated from a bottom portion 74 (not shown in FIG. 3) by a protruding stiffening rib 65 that protrudes into the recess 66 towards the interior side 61 of the second side frame stiffener 60B. The top portion 72 of each of the plurality of recesses 66 is proximal to the top surface 70 of the second side frame stiffener 60B and the top portion 72 is defined by a wall 90 that is shaped to closely conform to the curvature of, but not to engage, a top rolling member 52 of a dumbbell roller 50 (see FIG. 2A) used in the power tong 10 to engage and stabilize the ring gear 12 (see FIG. 2) during rotation. Similarly, the protruding rib 65 disposed within each recess 66 and which separates, within each recess 66, the top portion 72 from the bottom portion 74, is shaped to closely conform to, but not to engage, the axle 56 that connects the top rolling member 52 to the bottom rolling member 54 of each dumbbell roller 50. Similarly, the bottom portion 74 (not shown in FIG. 3—see FIG. 4) of each of the plurality of recesses 66 is proximal to the bottom surface 71 (not shown in FIG. 3—see FIG. 4) of the second side frame stiffener 60B and shaped to closely conform to the curvature of, but not to engage, a bottom rolling member 54 of a dumbbell roller 50. The top surface 70 is disposed intermediate the proximal end 63 and the distal end 64 of the second side frame stiffener 60B. Optionally, a proximal end 63 includes a truncated recess 76 having a protruding rib 75 that separates a truncated recess top portion 55 from a truncated recess bottom portion 68 (not shown in FIG. 3—see FIG. 4). Optionally, the distal end 64 includes a truncated recess 76 having a protruding rib 75 that separates a truncated recess top portion 55 from a truncated recess bottom portion 68 (not shown in FIG. 3—see FIG. 4).

It will be understood that, just as FIG. 3 is applicable to the second side frame stiffener 60B shown disposed within the power tong frame 15 in FIG. 2 (on the left between the second bend 50B of dumbbell rollers 50 and the second side wall 21 of the frame 15 of the power tong 10), a mirror-image of FIG. 3 would be applicable to the first side frame stiffener 60A disposed within the power tong frame 15 in FIG. 2 (on the right between the first bend 50A of dumbbell rollers 50 and the first side wall 19 of the frame 15 of the power tong 10).

Returning to FIG. 3, the top surface 70 of embodiment of the second side frame stiffener 60B is securable to a top plate 23 (not shown in FIG. 3—see FIG. 1) of a frame 15 of a power tong 10 using conventional fasteners (not shown in FIG. 3) such as, for example, threaded nuts 29 having a hexagonal shape for engagement with a wrench or other tool for application of torque. The plurality of threaded holes 69 shown in FIG. 3 are strategically disposed about the top surface 70 for threadedly receiving fasteners (not shown in FIG. 3—see FIGS. 1 and 2A).

FIG. 4 is bottom plan view of the embodiment of the second side frame stiffener 60B of FIG. 3 for being disposed within a frame 15 of a power tong 10 to prevent unwanted warping or deformation of the frame 15. FIG. 4 reveals the second side frame stiffener 60B prior to being installed within the frame 15 for providing resistance to warping and/or deformation of the frame 15. The second side frame stiffener 60B includes the interior side 61, the outer side 62 opposite the interior side 61, the top surface 70 (not shown in FIG. 4—see FIG. 3) intermediate the interior side 61 and the outer side 62, the bottom surface 71 opposite the top surface 70 and intermediate the interior side 61 and the outer side 62, and the plurality of recesses 66 disposed along the interior side 61 of the second side frame stiffener 60B. Each of the recesses 66 includes the top portion 72 (not shown in FIG. 4—see FIG. 3) separated from a bottom portion 74 by the protruding stiffening rib 65 that protrudes into the recess 66 towards the interior side 61 of the second side frame stiffener 60B. The protruding rib 65 disposed within each recess 66 separates, within each recess 66, the top portion 72 (not shown—see FIG. 3) from the bottom portion 74, and is shaped to closely conform to, but not to engage, the axle 56 that connects the top rolling member 52 to the bottom rolling member 54 of each dumbbell roller 50. The bottom portion 74 (which was not shown in FIG. 3) of each of the plurality of recesses 66 is proximal to the bottom surface 71 of the second side frame stiffener 60B and shaped to closely conform to the curvature of, but not to engage, a bottom rolling member 54 of a dumbbell roller 50. The bottom surface 71, like the top surface 70 shown in FIG. 3, is disposed intermediate the proximal end 63 and the distal end 64 of the second side frame stiffener 60B. Optionally, a proximal end 63 includes a truncated recess 76 having a protruding rib 75 that separates a truncated recess top portion 55 (not shown in FIG. 4—see FIG. 3) from a truncated recess bottom portion 68. Optionally, the distal end 64 includes a truncated recess 76 having a protruding rib 75 that separates a truncated recess top portion 55 (not shown in FIG. 4—see FIG. 3) from a truncated recess bottom portion 68.

Just as the top surface 70 shown in FIG. 3 is securable to the top plate 23 of the frame 15 of the power tong of FIG. 1, the bottom surface 71 of the second side frame stiffener 60B of FIG. 4 the is securable to the bottom plate 24 (not shown in FIG. 3—see FIGS. 1 and 2) of a frame 15 of a power tong 10 using conventional fasteners (not shown in FIG. 4) such as, for example, threaded nuts 29 having a hexagonal shape for engagement with a wrench or other tool for application of torque. The plurality of threaded holes 69 shown in FIG. 4 are strategically disposed about the bottom surface 71 for threadedly receiving fasteners such as bolts or nuts 29 on the axle 56 (not shown in FIG. 4—see FIGS. 1 and 2A).

FIG. 5 is a view of the interior side 61 of the second side frame stiffener 60B of FIGS. 3 and 4 showing the top surface 70, the bottom surface 71, the proximal end 63, the distal end 64, the plurality of recesses 66 disposed intermediate the top surface 70 and the bottom surface 71 and also intermediate the proximal end 63 and the distal end 64, each recess 66 having a top portion 72 that is proximal to the top surface 70 and a bottom portion 74 that is proximal to the bottom surface 71, the top portion 72 of each recess 66 separated from the bottom portion 74 of each recess 66 by a protruding rib 65. Also shown in FIG. 5 is a truncated recess 76 proximal to the proximal end 63 of the frame stiffener 60B having a protruding truncated recess rib 75 separating a truncated recess top portion 55 from a truncated recess bottom portion 68. Also shown in FIG. 5 is a truncated recess 76 proximal to the proximal end 64 of the frame stiffener 60B having a protruding truncated recess rib 75 separating a truncated recess top portion 55 from a truncated recess bottom portion 68.

FIG. 6 is a view of the distal end 64 view of the second side frame stiffener 60B of FIGS. 3 and 5 showing the truncated recess 76 having a protruding rib 75 therein to separate a truncated recess top portion 55 from a truncated recess bottom portion 68.

Figure 7:
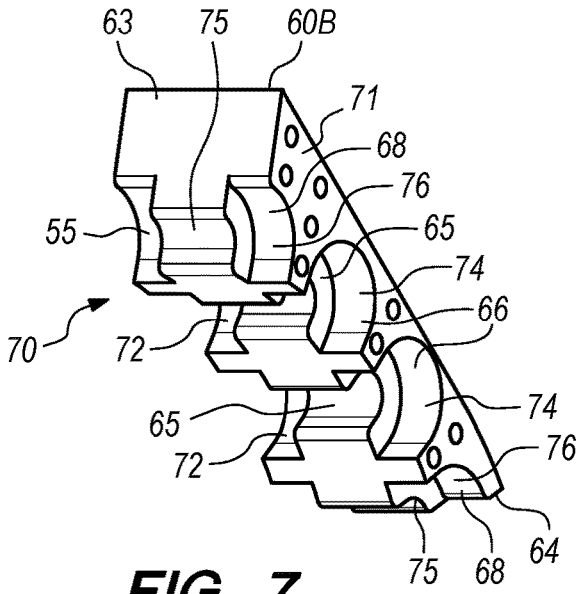
FIG. 7 is a perspective view of the second side frame stiffener of FIG. 3.

FIG. 7 is a perspective view of the second side frame stiffener 60B of FIG. 3 having the top surface 70 (not shown but indicated by arrow), the bottom surface 71, the interior side 61, the plurality of recesses 66, each recess 66 including a top portion 72, a bottom portion 74 and a protruding rib 65 separating the top portion 72 from the bottom portion 74 of each of the plurality of recesses 66. The frame stiffener 60B of FIG. 7 includes a truncated recess 76 disposed proximal to the proximal end 63 and another at the distal end 64, each truncated recess 76 having a bottom portion 68 proximal to the second side 71 and a top portion 55 (bottom portion 68 at the distal end 64 not shown in FIG. 7—see FIG. 8), each truncated recess bottom portion 68 separated from the truncated recess top portion 55 by a protruding rib 75.

Figure 8:
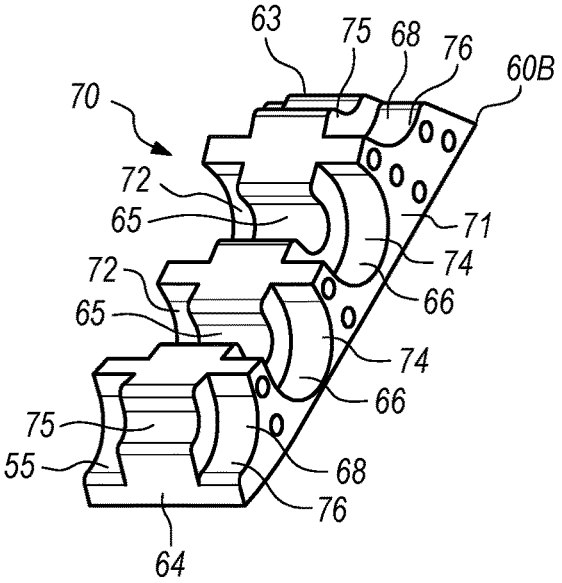
FIG. 8 is another perspective view of the second side frame stiffener of FIGS. 3 and 7.

FIG. 8 is a perspective view of the second side frame stiffener of FIG. 7 from another angle. FIG. 8 shows the second side frame stiffener 60B having the top surface 70 (not shown but indicated by arrow), the bottom surface 71, the interior side 61, the plurality of recesses 66, each recess 66 including a top portion 72, a bottom portion 74 and a protruding rib 65 separating the top portion 72 from the bottom portion 74 of each of the plurality of recesses 66. The frame stiffener 60B of FIG. 8 includes a truncated recess 76 at each of the proximal end 63 and the distal end 64, each truncated recess 76 having a bottom portion 68 proximal to the second side 71 and a top portion 55 (truncated recess top portion at proximal end 63 not shown in FIG. 7—see FIG. 8), the bottom portion 68 separated from the top portion 55 by a protruding rib 75.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A power tong for gripping and rotating a tubular joint, the power tong comprising:

a frame having a top plate, a bottom plate parallel to the top plate, a first side wall extending from a first side edge of the top plate to a first side edge of the bottom plate, and a second side wall extending from a second side edge of the top plate to a second side edge of the bottom plate, the first side wall being opposite to and spaced apart from the second side wall of the frame;

a ring gear rotatably received within the frame, the ring gear having an interior bay for receiving the tubular joint, a pair of interior opposed camming surfaces straddling the interior bay and a radially outwardly extending row of gear teeth about a periphery of the ring gear;

a pair of opposed gripping jaws movably captured within the interior bay of the ring gear proximal to the opposed camming surfaces, the gripping jaws deployable, by rotation of the ring gear and the camming surfaces thereof within the frame, from a retracted position, within a pair of opposed recesses formed in the interior bay of the ring gear, to a deployed position radially inwardly towards a center axis of the interior bay of the ring gear to engage and grip the tubular joint;

a motor;

a drive gear coupled to be driven to rotate by operation of the motor;

at least one driven gear coupled to be driven to rotate by the drive gear to transfer torque from the motor, through the drive gear and the at least one driven gear to the ring gear by engagement of peripheral teeth on the at least one driven gear with the teeth on the periphery of the ring gear;

a first plurality of dumbbell rollers secured within the frame in a first bend along a first side periphery of the ring gear on a first side of the frame, intermediate the periphery of the ring gear and the first side wall, each dumbbell roller of the first plurality of dumbbell rollers rotatably secured intermediate the top plate and the bottom plate, each dumbbell roller of the first plurality of dumbbell rollers having a top rolling member having a first radius positioned to rollably engage the periphery of the ring gear above the row of gear teeth, a bottom rolling member having a second radius positioned to rollably engage the periphery of the ring gear below the row of gear teeth, and a circumferential groove intermediate the top rolling member and the bottom rolling member;

a second plurality of dumbbell rollers secured within the frame in a second bend along a second side periphery of the ring gear and on a second side of the frame, intermediate the ring gear and the second side wall, each dumbbell roller of the second plurality of dumbbell rollers rotatably secured intermediate the top plate and the bottom plate, each of the dumbbell rollers of the second plurality of dumbbell rollers having a top rolling member having the first radius positioned to rollably engage the periphery of the ring gear above the row of gear teeth, a bottom rolling member having the second radius positioned to rollably engage the periphery of the ring gear below the row of gear teeth, and a circumferential groove intermediate the top rolling member and the bottom rolling member; and a first side frame stiffener disposed intermediate the first side wall of the frame and the first plurality of dumbbell rollers and intermediate the top plate and the bottom plate of the frame, the first side frame stiffener having a top surface secured to the top plate of the frame, a bottom surface secured to the bottom plate of the frame, a proximal end proximal a rear of the frame, a distal end opposite the proximal end and proximal a front of the frame, an outer side disposed proximal to the first side wall and an interior side having a plurality of recesses, each of the plurality of recesses including a top portion with a mouth proximal to the interior bay and an arced portion having a radius exceeding the first radius distal to the interior bay, a bottom portion with a mouth proximal to the interior bay an arced portion having a radius exceeding the second radius distal to the interior bay, and a protruding stiffening rib disposed intermediate the top portion and the bottom portion of each recess, the protruding stiffening rib received within the circumferential groove of an adjacent dumbbell roller of the first plurality of dumbbell rollers; and a second side frame stiffener disposed intermediate the second side wall of the frame and the second plurality of dumbbell rollers and intermediate the top plate and the bottom plate of the frame, the second side frame stiffener having a top surface secured to the top plate, a bottom surface secured to the bottom plate, a proximal end proximal the rear of the frame, a distal end opposite the proximal end and proximal the front of the frame, an outer side disposed proximal to the second side wall and an interior side having a plurality of recesses, each of the plurality of recesses including a top portion with a mouth proximal to the interior bay and an arced portion having a radius exceeding the first radius distal to the interior bay, a bottom portion with a mouth proximal to the interior bay and an arced portion having a radius exceeding the second radius distal to the interior bay, and a protruding stiffening rib disposed intermediate the top portion and the bottom portion of each recess, the protruding stiffening rib received within the circumferential groove of an adjacent dumbbell roller of the second plurality of dumbbell rollers;

wherein, during operation of the power tong, torque produced by the motor is transferred through the drive gear and the at least one driven gears to the ring gear to rotate the ring gear to engage the straddling pair of camming surfaces with the opposed gripping jaws and to deploy the gripping jaws to adduct each towards the other to engage and grip the tubular joint therebetween;

wherein as the ring gear continues to rotate after the gripping jaws engage and grip the tubular joint, the tubular joint rotates with the ring gear and the pair of engaged gripping jaws;

wherein the first side frame stiffener and the second side frame stiffener resist deformation of the frame; and wherein a plurality of dumbbell rollers are disposed intermediate the proximal end of the first side frame stiffener and the proximal end of the second side frame stiffener, the plurality of dumbbell rollers also being adjacent to the periphery of the ring gear that is intermediate the first side frame stiffener and the second side frame stiffener.

2. The power tong of claim 1, wherein the first side frame stiffener further comprises:

a truncated recess at a proximal end of the first side frame stiffener, the truncated recess including a top portion having a radius exceeding the first radius, a bottom portion having a radius exceeding the second radius, and a protruding stiffening rib disposed intermediate the top portion and the bottom portion of the truncated recess, the protruding stiffening rib received within the circumferential groove of an adjacent dumbbell roller of the first plurality of dumbbell rollers.

3. The power tong of claim 1, wherein the first side frame stiffener further comprises:

a truncated recess at a distal end of the first side frame stiffener, the truncated recess including a top portion having a radius exceeding half of the first radius, a bottom portion having a radius exceeding half of the second radius, and a protruding stiffening rib received in the circumferential groove of an adjacent dumbbell roller of the first plurality of dumbbell rollers.

4. The power tong of claim 1, wherein each of the plurality of recesses of the interior side of the first side frame stiffener outwardly terminate at an arc portion forming an arc of 180 degrees.

5. The power tong of claim 1, wherein the first side frame stiffener includes a plurality of threaded holes in the top surface;

wherein the first side frame stiffener includes a plurality of threaded holes in the bottom surface;

wherein the second side frame stiffener includes a plurality of threaded holes in the top surface;

wherein the second side frame stiffener includes a plurality of threaded holes in the bottom surface; and wherein the first side frame stiffener and the second side frame stiffener are each secured intermediate the top plate and the bottom plate of the frame by a plurality of threaded fasteners, each of which penetrate one of an aperture in the top plate of the frame and an aperture of the bottom plate of the frame.

6. The power tong of claim 1, wherein the first side frame stiffener and the second side frame stiffener are machined from a body of high strength steel.

7. The power tong of claim 1, wherein the plurality of recesses are formed into the interior side of the first side frame stiffener to dispose the top portion of each of the plurality of recesses proximal to the top rolling member of the adjacent dumbbell roller of the first plurality of dumbbell rollers, to dispose a bottom portion of each of the plurality of recesses proximal to the bottom rolling member of the adjacent dumbbell roller of the first plurality of dumbbell rollers, and to dispose the central protruding rib of each of the plurality of recesses within the groove formed intermediate the top rolling member and the bottom rolling member of the adjacent dumbbell roller of the first plurality of dumbbell rollers.

8. The power tong of claim 7, wherein the plurality of recesses are formed into the interior side of the second side frame stiffener to dispose a top portion of each of the plurality of recesses proximal to the top rolling member of the adjacent dumbbell roller of the second plurality of dumbbell rollers, to dispose a bottom portion of each of the plurality of recesses proximal to the bottom rolling member of the adjacent dumbbell roller of the second plurality of dumbbell rollers, and to dispose the central protruding rib of each of the plurality of recesses within the groove formed intermediate the top rolling member and the bottom rolling member of the adjacent dumbbell roller of the second plurality of dumbbell rollers.

9. The power tong of claim 1, wherein the first side stiffener and the second side frame stiffener are each secured to the top plate and to the bottom plate by welding.

10. The power tong of claim 1, wherein the at least one driven gear comprises:

two driven gears, each disposed proximal the rear of the frame.

* * * * *